US009084036B2

(12) United States Patent
Jiang et al.

(10) Patent No.: US 9,084,036 B2
(45) Date of Patent: Jul. 14, 2015

(54) SIGNAL SOURCE LOCALIZATION USING COMPRESSIVE MEASUREMENTS

(75) Inventors: Hong Jiang, Warren, NJ (US); Boyd T. Mathews, Summit, NJ (US); Paul A. Wilford, Bernardsville, NJ (US)

(73) Assignee: Alcatel Lucent, Boulogne-Billancourt (FR)

( * ) Notice: Subject to any disclaimer, the term of this patent is extended or adjusted under 35 U.S.C. 154(b) by 793 days.

(21) Appl. No.: 13/109,592

(22) Filed: May 17, 2011

(65) Prior Publication Data

US 2012/0294456 A1 Nov. 22, 2012

(51) Int. Cl.
*H04R 3/00* (2006.01)

(52) U.S. Cl.
CPC ..... *H04R 3/005* (2013.01)

(58) Field of Classification Search
USPC ..... 381/11–115, 120, 122; 704/203; 367/128; 375/130, 219, 229, 260
See application file for complete search history.

(56) References Cited

U.S. PATENT DOCUMENTS

| | | | | |
|---|---|---|---|---|
| 5,778,082 | A * | 7/1998 | Chu et al. | 381/92 |
| 6,774,934 | B1 * | 8/2004 | Belt et al. | 348/211.1 |
| 8,094,833 | B2 * | 1/2012 | Mao et al. | 381/92 |
| 8,280,671 | B2 * | 10/2012 | Luo et al. | 702/118 |
| 8,379,485 | B2 * | 2/2013 | Cevher et al. | 367/128 |
| 2011/0157300 | A1 * | 6/2011 | Solvang | 348/14.16 |
| 2014/0244214 | A1 * | 8/2014 | Boufounos et al. | 702/189 |

OTHER PUBLICATIONS

Elsner et al, Compressed spectrum estimation for cognitive radios, Jun. 2010.*
Benesty, adaptive eigenvalue decomposition algorithm for passive acoustic source localization, JAS 2000.*
Gui et al, Sparse Multipath Channel Estimation Using Compressive Sampling Matching Pursit Algorithm, IEEE 2010.*
E.J. Candés et al., "An Introduction to Compressive Sampling," IEEE Signal Processing Magazine, Mar. 2008, pp. 21-30, vol. 25, No. 2.
Emmanuel J. Candés, "Compressive Sampling," 2006 European Mathematical Society, Proceedings of the International Congress of Mathematicians, 2006, pp. 1-20, Madrid, Spain.
(Continued)

*Primary Examiner* — Davetta W Goins
*Assistant Examiner* — Kuassi Ganmavo
(74) *Attorney, Agent, or Firm* — Ryan, Mason & Lewis, LLP

(57) ABSTRACT

In one aspect, a method for performing signal source localization is provided. The method comprises the steps of obtaining compressive measurements of an acoustic signal or other type of signal from respective ones of a plurality of sensors, processing the compressive measurements to determine time delays between arrivals of the signal at different ones of the sensors, and determining a location of a source of the signal based on differences between the time delays. The method may be implemented in a processing device that is configured to communicate with the plurality of sensors. In an illustrative embodiment, the compressive measurements are obtained from respective ones of only a designated subset of the sensors, and a non-compressive measurement is obtained from at least a given one of the sensors not in the designated subset, with the time delays between the arrivals of the signal at different ones of the sensors being determined based on the compressive measurements and the non-compressive measurement.

20 Claims, 2 Drawing Sheets

(56) References Cited

OTHER PUBLICATIONS

E. Candés et al., "Robust Uncertainty Principles: Exact Signal Reconstruction from Highly Incomplete Frequency Information," IEEE Transactions on Information Theory, Feb. 2006, pp. 489-509, vol. 52, No. 2.
C.Y. Knapp et al., "The Generalized Correlation Method for Estimation of Time Delay," IEEE Transactions on Acoustics, Speech and Signal Processing, Aug. 1976, pp. 320-327, vol. 24, No. 4.
C. Feng et al., "Multiple Target Localization Using Compressive Sensing," IEEE Global Telecommunications Conference (GLOBECOM), Nov.-Dec. 2009, 6 pages, Honolulu, Hawaii.
V. Cevher et al., "Distributed Target Localization Via Spatial Sparsity," Proceedings of the 16th European Signal Processing Conference (EUSIPCO), Aug. 2008, 5 pages, Laussane, Switzerland.
B. Zhang et al., "Sparse Target Counting and Localization in Sensor Networks Based on Compressive Sensing," IEEE INFOCOM, Apr. 2011, 9 pages.
Y. Rachlin et al., "The Secrecy of Compressed Sensing Measurements," IEEE 46th Annual Allerton Conference on Communication, Control, and Computing, Sep. 2008, pp. 813-817.
A. Orsdemir et al., "On the Security and Robustness of Encryption via Compressed Sensing," IEEE Military Communications Conference, Nov. 2008, pp. 1-7.
Jiangtao Wen, "Key Issues in Secure, Error Resilient Compressive Sensing of Multimedia," IEEE International Conference on Multimedia and Expo, Jun.-Jul. 2009, pp. 1590-1591.
Iddo Drori, "Compressed Video Sensing," http://www.cs.tau.ac.il/~idori/cvs.pdf, 2008, 2 pages.
T.L. Marzetta et al., "Capacity of a Mobile Multiple-Antenna Communication Link in Rayleigh Flat Fading," IEEE Transactions on Information Theory, Jan. 1999, pp. 139-157, vol. 45, No. 1.
T.L. Marzetta et al., "Structured Unitary Space-Time Autocoding Constellations," IEEE Transactions on Information Theory, Apr. 2002, pp. 942-950, vol. 48, No. 4.
J. Valin et al., "Robust Sound Source Localization Using a Microphone Array on a Mobile Robot," Proceedings of IEEE/RSJ International Conference on Intelligent Robots and Systems (IROS), Oct. 2003, pp. 1228-1233, vol. 2.
D.D. Rife et al., "Transfer-Function Measurement with Maximum-Length Sequences," Journal of the Audio Engineering Society, Jun. 1989, pp. 419-444, vol. 37, No. 6.
Y. Lin et al., "Nonnegative Deconvolution for the Time of Arrival Estimation," IEEE International Conference on Acoustics, Speech, and Signal Processing (ICASSP), May 2004, pp. 377-380, vol. 2.
G.C. Carter et al., "The Smoothed Coherence Transform," Proceedings of the IEEE, Oct. 1973, pp. 1497-1498, vol. 61, No. 10.

* cited by examiner

SIGNAL SOURCE LOCALIZATION USING COMPRESSIVE MEASUREMENTS

FIELD OF THE INVENTION

The present invention relates generally to the field of signal processing, and more particularly to signal source localization techniques.

BACKGROUND OF THE INVENTION

Signal source localization is an important signal processing function in a wide variety of different types of systems. For example, networks of sound sensors are often used to locate and track the source of an acoustic signal associated with a sound event in applications such as security and surveillance. In such arrangements, a signal in the form of a sound wave from a sound source is typically sampled at each of the sensors, and an algorithm is applied to the resulting samples in order to estimate the location of the source based on differences in the arrival times of the sound wave at each of the sensors.

Conventional arrangements of this type are problematic, however, in that each of the sensors of the sensor network is generally required to operate at a sampling rate that is at or above the Nyquist rate, where the Nyquist rate denotes the minimum sampling rate required to avoid aliasing, which is twice the highest frequency of the signal being sampled. Time-domain samples of the sound wave from each of the sensors of the sensor network are applied to a processing device that implements the above-noted signal source localization algorithm. Thus, in order to achieve a sufficiently accurate localization result, not only is the use of high rate sampling required at each of the sensors, but those samples must be reliably transmitted to the processing device at a similarly high rate. The sampling and transmission operations therefore typically involve the use of significant hardware resources, which unduly increases the cost, complexity and power consumption of the sensors. Similar problems exist in other types of signal source localization applications.

Accordingly, there exists a need for improved signal source localization techniques, which can derive accurate localization results from a sensor network without requiring that all of the sensors of the network operate at a high sampling rate. Such techniques would ideally provide a significant reduction in the cost, complexity and power consumption of the sensors of the sensor network, without adversely impacting the desired accuracy of the signal source localization result.

SUMMARY OF THE INVENTION

Illustrative embodiments of the present invention overcome one or more of the above-described drawbacks of conventional signal source localization techniques. For example, in a given one of these embodiments, only a single sensor of a plurality of sensors used in signal source localization operates at or above the Nyquist rate, while the remaining sensors of the plurality of sensors all generate compressive measurements at a substantially lower sampling rate through the use of compressive sampling. In another embodiment, all of the plurality of sensors used in the signal source localization can generate compressive measurements. The sensors generating the compressive measurements each take a much smaller number of samples within a given period of time than would a conventional sensor operating at or above the Nyquist rate, and can also transmit those samples to a processing device at a similar low rate. Moreover, the accuracy of the signal source localization result based on the compressive measurements is not adversely impacted.

In accordance with one aspect of the invention, a method for performing signal source localization is provided. The method comprises the steps of obtaining compressive measurements of an acoustic signal or other type of signal from respective ones of a plurality of sensors, processing the compressive measurements to determine time delays between arrivals of the signal at different ones of the sensors, and determining a location of a source of the signal based on differences between the time delays. The method may be implemented in a processing device that is configured to communicate with the plurality of sensors. The compressive measurements may be obtained from respective ones of only a designated subset of the sensors, and a non-compressive measurement may be obtained from at least a given one of the sensors not in the designated subset, with the time delays between the arrivals of the signal at different ones of the sensors being determined based on the compressive measurements and the non-compressive measurement.

Other aspects of the invention include a processing device configured to process compressive measurements received from multiple sensors in order to determine a location of a signal source, a sensor comprising a compressive sampling module for generating a compressive measurement, a system comprising a sensor network and a processing device configured to process compressive measurements received from sensors of the sensor network, and related computer program products.

The illustrative embodiments provide significant advantages over conventional approaches. For example, in one or more of these embodiments, the sensors generating compressive measurements can be implemented as simple, low-cost sensors that operate at low sampling rates, and therefore do not require significant hardware resources or exhibit high power consumption. This considerably facilitates the widespread deployment of sensor networks, particularly in remote locations with harsh conditions, or in other environments that are unsuitable for installation of complex and costly sensors.

These and other features and advantages of the present invention will become more apparent from the accompanying drawings and the following detailed description.

DETAILED DESCRIPTION OF THE INVENTION

The present invention will be illustrated herein in conjunction with exemplary communication systems and associated sensor networks, processing devices and signal localization techniques. It should be understood, however, that the invention is not limited to use with the particular types of systems, devices and techniques disclosed. For example, aspects of the present invention can be implemented in a wide variety of other communication, sensor network or other processing system configurations, and in numerous alternative compressive sampling applications.

Figure 1:
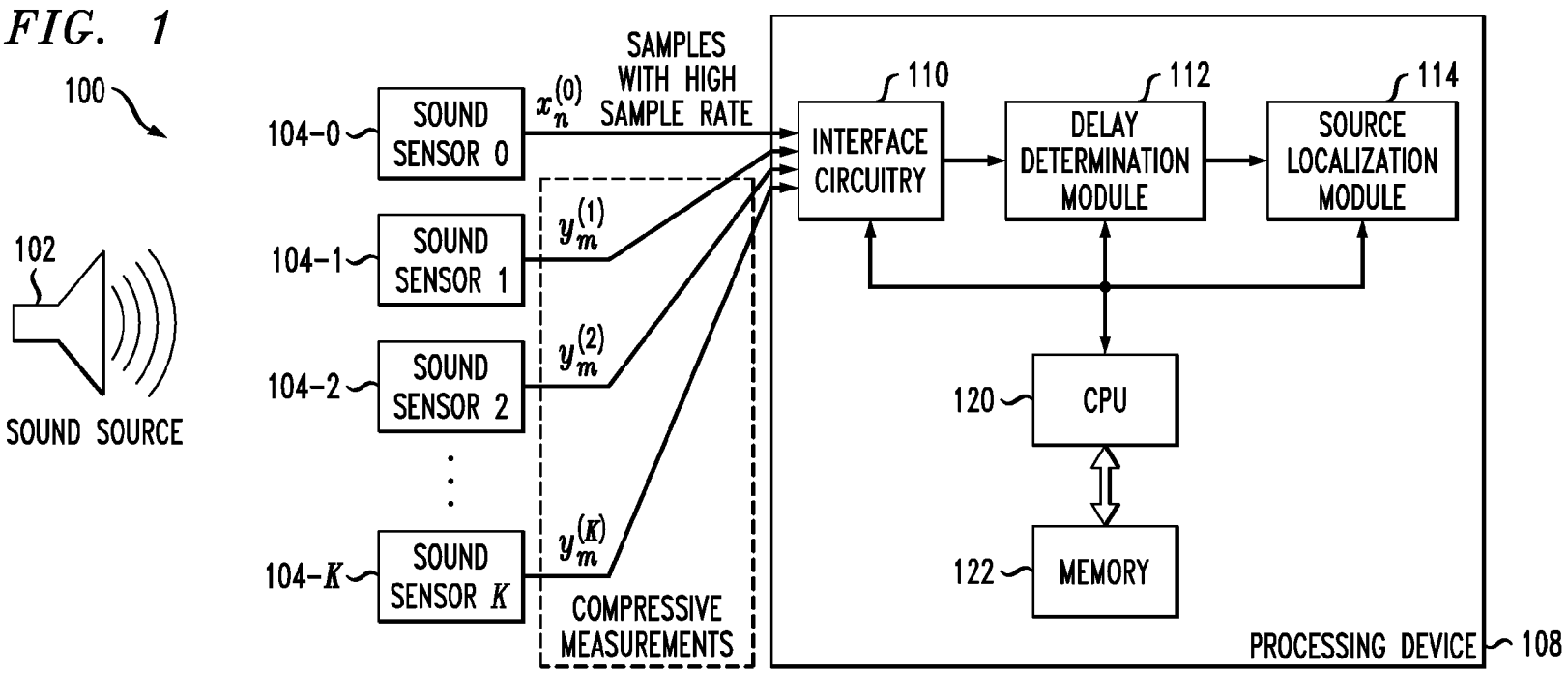
FIG. 1 is a block diagram of a system implementing compressive sampling based signal source localization in a first illustrative embodiment of the invention.

FIG. 1 shows a communication system 100 in which an acoustic signal from a sound source 102 is detected by each of a plurality of sound sensors 104-0, 104-1, 104-2, . . . 104-K. A designated subset of the set of K+1 sensors 104 generate respective compressive measurements, while at least one of the sensors 104 not in the designated subset generates a non-compressive measurement. More particularly, in the present embodiment, only the first sensor 104-0 generates a non-compressive measurement in the form of a signal vector $x_n^{(0)}$ comprising time-domain samples generated at a high sampling rate that is at or above the Nyquist rate, where n=1, . . . N, while the remaining K sensors 104-1 through 104-K generate respective compressive measurements $y_m^{(1)}$, $y_m^{(2)}$, . . . $y_m^{(K)}$ at a much lower sampling rate, substantially below the Nyquist rate, where m=1, . . . M. Thus, in the present embodiment, the non-compressive measurement comprises a relatively high sampling rate measurement and the compressive measurements comprise relatively low sampling rate measurements.

Compressive sampling, also known as compressed sampling, compressed sensing or compressive sensing, is a data sampling technique which exhibits improved efficiency relative to conventional Nyquist sampling. Compressive sampling in an illustrative embodiment may be characterized mathematically as multiplying an N-dimensional signal vector by an M×N dimensional sampling matrix $\phi$ to yield an M-dimensional compressed measurement vector, where typically M is much smaller than N. If the signal vector is sparse in a domain that is linearly related to that signal vector, then the signal vector can be recovered from the compressed measurement vector.

Thus, compressive sampling allows sparse signals to be represented and reconstructed using far fewer samples than the number of Nyquist samples. When a signal has a sparse representation, the signal may be reconstructed from a small number of measurements from linear projections onto an appropriate basis. Furthermore, the reconstruction has a high probability of success even if a random sampling matrix is used.

Additional details on conventional aspects of compressive sampling can be found in, for example, E. J. Candès and M. B. Wakin, "An Introduction to Compressive Sampling," IEEE Signal Processing Magazine, Vol. 25, No. 2, March 2008, E. J. Candès, "Compressive Sampling," Proceedings of the International Congress of Mathematicians, Madrid, Spain, 2006, and E. Candès et al., "Robust uncertainty principles: Exact signal reconstruction from highly incomplete frequency information," IEEE Trans. on Information Theory, Vol. 52, No. 2, pp. 489-509, February 2006.

A given one of the compressive measurements $y_m^{(i)}$, i=1, 2, . . . K may be viewed as being generated as a product of a corresponding signal vector $x_n^{(i)}$ and a sampling matrix $\phi$. As will be described in more detail below, the sampling matrix $\phi$ may be formed using maximum length sequences, also referred to as m-sequences, although other types of sampling matrices may be used in other embodiments.

Figure 2:
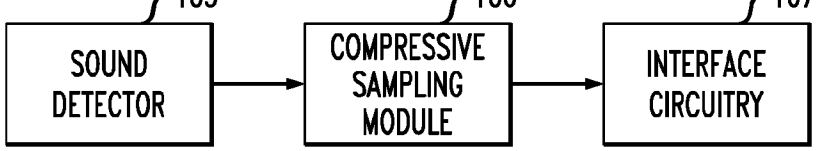
FIG. 2 shows a more detailed view of an exemplary sensor configured to generate compressive measurements in the FIG. 1 system.

As shown in FIG. 2, sound sensor 104-1 comprises a sound detector 105, a compressive sampling module 106, and interface circuitry 107. The compressive sampling module 106 generates a compressive measurement from a detection output of the sound detector 105. More particularly, the compressive sampling module 106 may be configured, for example, to form the above-noted product of a signal vector and a sampling matrix. The interface circuitry 107 is configured to transmit the compressive measurement generated by module 106 to a processing device 108.

Therefore, in the communication system 100 of FIG. 1, the non-compressive measurement) $x_n^{(0)}$ and the compressive measurements $y_m^{(1)}$, $y_m^{(2)}$, $y_m^{(K)}$ are provided to processing device 108, which utilizes these measurements to determine a location of the sound source 102.

The processing device 108 comprises interface circuitry 110, a delay determination module 112, and a source localization module 114. The interface circuitry 110 is configured to receive the compressive and non-compressive measurements from interface circuitry associated with respective ones of the sound sensors 104. These measurements may be communicated from the sensor 104 to the processing device 108 over a network, not explicitly shown in FIG. 1, and the network may comprise a wide area network such as the Internet, a metropolitan area network, a local area network, a cable network, a telephone network, a satellite network, as well as portions or combinations of these or other networks. A wide variety of other wired or wireless interconnections may be used to support communication between the sensors 104 and the processing device 108. Thus, interface circuitry 107 and interface circuitry 110 may comprise conventional transceivers configured to support communication over a network or other type of wired or wireless connection. The configuration and operation of such transceivers are well known in the art and will therefore not be described in further detail herein.

The delay determination module 112 processes the compressive and non-compressive measurements in order to determine time delays between arrivals of the acoustic signal from sound source 102 at different ones of the sensors 104.

The source localization module 114 is configured to determine a location of the sound source 102 based on the time delays.

The operations performed by module 112 and 114 may comprise, for example, otherwise conventional processing operations associated with determining signal source localization using time difference of arrival (TDOA) techniques. One or more such techniques may assume that the sound source 102 is sufficiently distant from the sensors 104 that the wavefront arriving at the sensor array approximates a plane. In one or more of the illustrative embodiments described herein, the TDOA may be determined using estimates of the channel response between the source and each of the sensors. Conventional aspects of a channel response approach to determining TDOA are described in J. Benesty et al., "Adaptive Eigenvalue Decomposition Algorithm," Microphone Array Signal Processing, pp. 207-208, Springer-Verlag, Berlin, Germany, 2008. The TDOA may alternatively be determined using cross-correlation of the sensor signals, as described in, for example, C. Y. Knapp et al., "The generalized correlation method for estimation of time delay," IEEE Transactions on Acoustics, Speech and Signal Processing, Vol. ASSP-24, pp. 320-327, August 1976. The present invention is therefore not limited in terms of the particular delay determination and source localization processes implemented in modules 112 and 114.

Although illustratively shown as separate modules in the FIG. 1 embodiment, the delay determination module 112 and the source localization module 114 may be combined into a single system component. The term "module" as used herein is therefore intended to be broadly construed, so as to encompass, for example, possibly overlapping portions of a given system component.

The processing device 108 further comprises a central processing unit (CPU) 120 coupled to a memory 122. At least a portion of one or more of the delay determination module 112 and the source localization module 114 may be implemented at least in part in the form of software stored in the memory 122 and executed by the CPU 120. The CPU is an example of what is more generally referred to herein as a "processor." The memory 122 may be an electronic memory such as random access memory (RAM), read-only memory (ROM) or combinations of these and other types of storage devices. Such a memory is an example of what is more generally referred to herein as a "computer program product" or still more generally as a "computer-readable storage medium" that has executable program code embodied therein. Other examples of computer-readable storage media may include disks or other types of magnetic or optical media, in any combination. Such storage media may be used to store program code that is executed by the CPU 120 in implementing signal source localization functionality within the processing device 108.

The processing device 108 may be implemented using, by way of example, a microprocessor, a microcontroller, a digital signal processor (DSP), an application-specific integrated circuit (ASIC), a field programmable gate array (FPGA), as well as portions or combinations of these or other devices. The processing device 108 may be implemented as a stand-alone communication device, such as a portable or laptop computer, a mobile telephone, a personal digital assistant (PDA), a wireless email device, a television set-top box (STB), a server, or other communication device suitable for communicating with the sensors 104 of the system 100 in order to locate the sound source 102.

It should be noted that although the communication system 100 is configured in the embodiment of FIG. 1 to locate a sound source, the disclosed techniques can be adapted in a straightforward manner to locate a wide variety of sources of other types of signals, including radio frequency (RF) signals and other types of electromagnetic signals. Thus, use of an acoustic signal in illustrative embodiments herein should be understood to be by way of non-limiting example only.

Also, although in the present embodiment only one of the K+1 sensors 104 generates a non-compressive measurement while the remaining K sensors generate compressive measurements, in other embodiments there may be more than one sensor that generates a non-compressive measurement. Thus, the designated subset of the complete set of K+1 sensors 104 that generate compressive measurements may comprise fewer than K of the sensors in other embodiments.

As indicated previously, in a conventional arrangement, all of the sensors of a sensor network used in signal source localization will generally be configured to sample a received signal at or above the Nyquist rate, and also to transmit the samples at a similar high rate, in order to provide a desired level of accuracy in the signal source localization result. The sampling and transmission operations therefore typically involve the use of significant hardware resources, which unduly increases the cost, complexity and power consumption of the sensors.

The present embodiment overcomes these drawbacks of conventional practice in that the sensors generating the compressive measurements each take a much smaller number of samples within a given period of time than would a conventional sensor operating at or above the Nyquist rate, and can also transmit those samples to a processing device at a similar low rate. Moreover, the accuracy of the signal source localization result based on the compressive measurements is not adversely impacted. The sensors generating the compressive measurements can be implemented as simple, low-cost sensors that operate at low sampling rates, and therefore do not require significant hardware resources or exhibit high power consumption. Such sensors may be configured to perform tasks as simply as possible, and to use as little power as possible, yet still provide enough data for the processing device 108 to reliably determine the location of the sound source 102. This considerably facilitates the widespread deployment of sensor networks, particularly in remote locations with harsh conditions, or in other environments that are unsuitable for installation of complex and costly sensors.

It should be noted that the particular configuration of communication system 100 as shown in FIGS. 1 and 2 is presented by way of illustrative example only.

The manner in which compressive measurements are generated by the designated subset of sensors 104 in system 100 will now be described in greater detail. A signal $x \in \Re^N$ may be considered sparse if it is comprised of only a small number of non-zero components when expressed in certain basis. Specifically, x is S-sparse if there exists an invertible matrix $\psi \in \Re^{N \times N}$ and a vector $h \in \Re^N$ such that $$x = \psi h, \text{ and } \|h\|_0 = S << N, \tag{1}$$

where $\|h\|_0$ is the number of nonzero elements of h. Since h has S nonzero elements, signal x can be uniquely represented by no more than 2S numbers in a straightforward way, using the locations and the values of the non-zero elements of h. However, this representation requires the availability of all N samples of signal x. In other words, this representation still requires the signal x to be acquired with N samples.

Compressive sampling makes it possible to acquire a sparse signal using far fewer than N measurements. In compressive sampling, a signal is projected onto a measurement basis, and the projections can be used to recover the signal. Specifically, let $\phi \in \Re^{M \times N}$ be a sampling matrix. Then the measurements $y \in \Re^M$ are given by $$y = \psi x. \tag{2}$$

The number of measurements M can be much smaller than the length N of vector x. Under the conditions that $\phi$ and $\psi$ are incoherent, and M is large enough with respect to S, the sparse signal x can be reconstructed from the measurements y by solving the following minimization problem:

$$\min \|h\|_1 \text{ subject to } \phi\psi h = y, \tag{3}$$

where $\|h\|_1$ is the sum of the absolute values of the components of h. After h is found from Equation (3), x may be computed as $x = \psi h$ . The minimization problem can be solved using standard linear programming techniques.

Although it is difficult to verify the incoherence condition for given sampling matrix $\phi$ and sparsity basis $\psi$, it is known that for a given sparsity basis $\psi$, a random sampling matrix $\phi$ has a high probability of being incoherent with $\psi$. In other words, the signal x has a high probability of being recovered from random measurements. In practice, it has been found that randomly permutated rows of a Walsh-Hadamard matrix may be used to form a sampling matrix with satisfactory results. Embodiments of the present invention utilize sampling matrices formed from shifted maximum length sequences, as will be described in detail below.

Referring again to FIG. 1, let s(t) represent the acoustic signal from the sound source 102, and $x^{(i)}(t)$ represent the corresponding signal arriving at the sensor i. Then signal $x^{(i)}(t)$ can be written as $$x^{(i)}(t) = \hat{h}^{(i)} * s + \hat{\eta}^{(i)} = \int_0^t \hat{h}^{(i)}(\tau) s(t-\tau) d\tau + \hat{\eta}^{(i)}, \tag{4}$$

where $\hat{h}^{(i)}(t)$ is the impulse response of the channel from the sound source 102 to the corresponding sensor 104-*i*, for i>0, and $\hat{\eta}^{(i)}(t)$ is Gaussian noise. We assume that the channel from the sound source to sensor 104-0 is invertible, i.e., there is a deconvolution of $x^{(0)}(t)$ so that $$s(t)=(g*x^{(0)})(t)+\eta^{(0)}(t). \tag{5}$$

Then Equations (4) and (5) give rise to the following equations $$x^{(i)}(t) = (h^{(i)} * x^{(0)})(t) + \eta^{(i)}(t) = \int_0^t h^{(i)}(\tau)x^{(0)}(t-\tau)d\tau + \eta^{(i)}(t),\ i = 1, 2, \ldots \tag{6}$$

where (7)

$$h^{(i)} = g * \hat{h}^{(i)},\ \eta^{(i)} = \hat{\eta}^{(i)} - g * \hat{\eta}^{(0)},\ i = 1, 2, \ldots$$

Equations (6) and (7) show that if a deconvolution of $x^{(0)}(t)$ exists, then each signal arriving at the other sensors $x^{(i)}(t)$, i=1, 2, . . . , is a convolution of $x^{(0)}(t)$ plus noise.

Let us now consider the discrete samples of the acoustic signals with sample duration T. Let $x^{(i)} \in \Re^N$, $x_n^{(i)}$, n=0, . . . , N be the samples of the signal $x^{(i)}(t)$, and $h^{(i)} \in \Re^N$, $h_n^{(i)}$, n=0, . . . , N be the samples of $h^{(i)}(t)$. For convenience, we assume without limitation that N is an even number.

We further assume that the number of samples N is large enough so that the support of $h^{(i)}(t)$ is contained within the interval [0, NT], that is, $$h^{(i)}(t)=0, t \notin [0, NT], i=1,2, \tag{8}$$

Equation (8) may not be satisfied for any finite N if the signal at sensor i=0 contains echoes. This is because even though $\hat{h}^{(i)}(t)$ and $\hat{h}^{(0)}(t)$ may have a finite support, the deconvolution g(t), and hence $h^{(i)}(t)=g(t)*\hat{h}^{(i)}(t)$, may not. Nevertheless, the amplitude of $h^{(i)}(t)$ outside of the interval [0, NT] can be made small enough to be ignored for sufficiently large N so that it is reasonable to assume that Equation (8) holds in practice for large N.

The discretized version of Equation (6) becomes $$x^{(i)} = \psi_0 h^{(i)} + \eta^{(i)},\ i = 1, 2, \ldots \tag{9}$$

where $$x^{(i)} = \begin{bmatrix} x_0^{(i)} \\ \vdots \\ x_N^{(i)} \end{bmatrix},\ h^{(i)} = \begin{bmatrix} h_0^{(i)} \\ \vdots \\ h_N^{(i)} \end{bmatrix}, \tag{10}$$

$$\psi_0 = \begin{bmatrix} x_{-\frac{N}{2}}^{(0)} & \cdots & x_0^{(0)} & \cdots & x_{\frac{N}{2}}^{(0)} \\ \vdots & \ddots & \vdots & \ddots & \vdots \\ x_{\frac{N}{2}}^{(0)} & \cdots & x_N^{(0)} & \cdots & x_{\frac{3N}{2}}^{(0)} \end{bmatrix}.$$

The vectors $h^{(i)}$, i=1, 2, . . . , are sparse because most of their entries are zero or small. The entries of $h^{(i)}$ with largest absolute values provide information on the time delay between signals $x^{(i)}(t)$ and $x^{(0)}(t)$. For example, if the time delay between $x^{(i)}(t)$ and $x^{(0)}(t)$ is an exact integer multiple of the sample duration T, then the time delay between the two signals is given by $$\Delta t^{(i)} = \left(\arg\max_j \{|h_j^{(i)}|\} - \frac{N}{2}\right)T. \tag{11}$$

Time delay of a fraction of sample duration may be obtained by interpolation using a few neighboring values of the entry with maximum absolute value.

Equation (9) shows that $x^{(i)}$ is a sparse signal with sparsity basis $\psi_0$. Note that no assumption has been made regarding the sparsity of the acoustic source signal s(t). Regardless of whether or not the source signal s(t) is sparse, the signal $x^{(i)}$ sampled at sensor i, i=1, 2, . . . , always has a sparse representation in the basis $\psi_0$ after $x^{(0)}$ is available. Therefore, the theory of compressive sampling may be directly applied to the sparse signals $x^{(i)}$, i=1, 2, . . . .

Let $\phi_i \in \Re^{M \times N}$ be the sampling matrix at sensor i. Each of the sensors i, i=1, 2, . . . takes compressive measurements $$y^{(i)}=\phi_i x^{(i)} \in \Re^M. \tag{12}$$

However, sensor i=0 takes samples $x^{(0)}$ of the sound wave using conventional sampling at the Nyquist rate.

In order to compute the time difference between $x^{(i)}$ and $x^{(0)}$, the Nyquist sampled signal) $x^{(0)}$ is used to form the sparsity basis $\psi_0$ in accordance with Equation (10). Then the channel response $h^{(i)}$ is computed from the minimization problem $$\min_{h^{(i)}} \|h^{(i)}\|_1,\ \text{subject to}\ \phi_i\psi_0 h^{(i)} = y^{(i)}, \tag{13}$$

which may also be written as $$\min_{h^{(i)}} \left\{\|h^{(i)}\|_1 + \frac{\mu}{2}\|\phi_i\psi_0 h^{(i)} - y^{(i)}\|_2\right\}, \tag{14}$$

where $\mu>0$ is a constant.

As indicated previously, the sampling matrix $\phi$ may be formed from maximum length sequences, also referred to as m-sequences. Let $p_n$, n=1, . . . , N be a binary m-sequence generated from a primitive polynomial. Then each row of the sampling matrix $\phi$ may be formed by a shifted sequence of $p_n$. For example, the entries of the sampling matrix can be defined by $$\phi_{ij}=1-2p_{(j+i) mod N}, i=1, \ldots, M, j=1, \ldots, N. \tag{15}$$

An advantage of using shifted m-sequences to form the sampling matrix is that the m-sequences can be easily implemented in hardware by using linear feedback shift registers, thereby reducing the complexity of matrix generation in the sensors 104.

It should be noted that all of the compressive measurement sensors 104-1 through 104-K need not use the same sampling matrix. However, different sampling matrices can be created with the same m-sequence, but with different shifts for the rows. Again, such an arrangement helps to reduce complexity.

A detection confidence indicator can be generated, as will now be described. The solution to the minimization problem in Equation (14) has a stochastic nature. This can be viewed from two aspects. First, when a random sampling matrix such as that in Equation (15) is used, the compressive sampling theory only guarantees the success of recovery with a high probability. Therefore, the peak value in the solution to Equation (14) only provides the correct time delay in the statistical sense. Secondly, the solution to Equation (14) is only meaningful when there is an acoustic signal from the source. For example, the signals at the sensors 104 are comprised of only noise when the source is silent, and the solution to Equation (14) would result in a peak at a random location.

The stochastic nature can be exploited to create a metric of the accuracy of the solution. In other words, we are able to utilize the characteristics of compressive sampling to create an indicator of how confident we are about the detection of the sound source 102. When M measurements $y^{(i)}$ are received from sensor i, they are used in Equation (14) to compute an estimate of the time delay $\Delta t^{(i)}$ as given by Equation (11). Similarly, any subset of the measurements may also be used to repeat the process. Therefore, the minimization process of Equation (14) may be performed multiple times, each time with a randomly selected small number of measurements removed from $y^{(i)}$, to compute multiple estimates of the time delay $\Delta t_j^{(i)}$. Here the subscript j denotes the repetition index of Equation (14) for the estimate of the same time delay $\Delta t^{(i)}$. The values of $\Delta t_j^{(i)}$, j=1, . . . , may be processed to produce a final estimate $\Delta t^{(i)}$ and a metric of confidence $C^{(i)}$. For example, they may be defined as $$\Delta t^{(i)} = \underset{j}{\text{median}}\{\Delta t_j^{(i)}\}, \tag{16}$$

$$C^{(i)} = \frac{1}{\max_j\{\Delta t_j^{(i)}\} - \min_j\{\Delta t_j^{(i)}\}}$$

Since these computations are performed by processing device 108, and not at the sensors 104, the complexity is not a concern.

Figure 3:
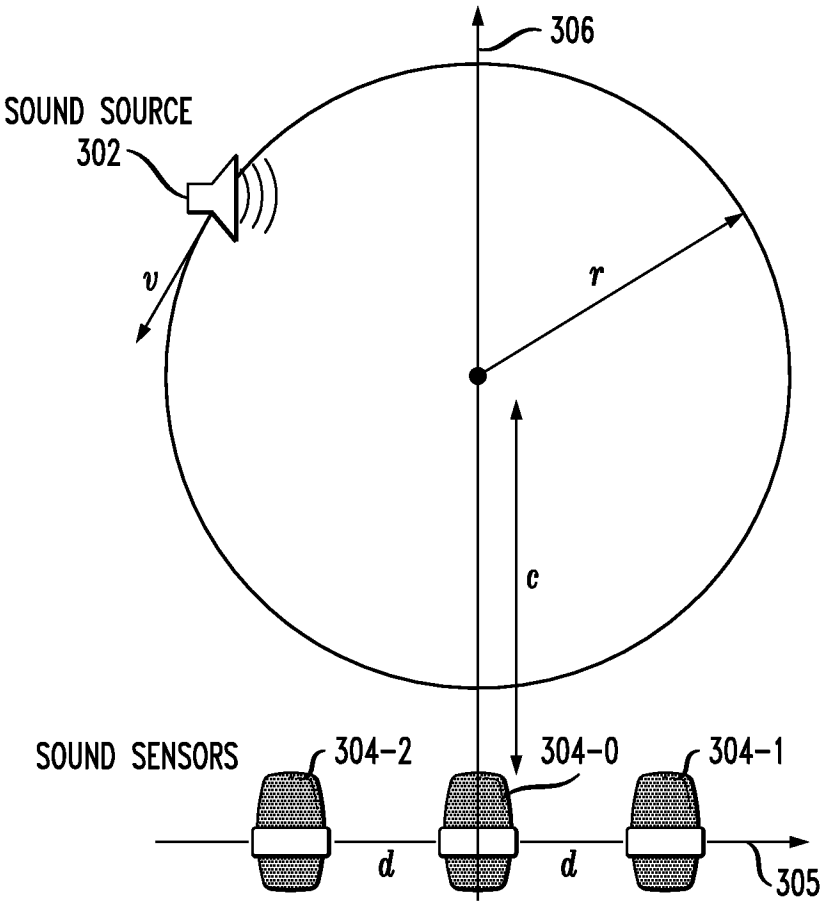
FIG. 3 shows a simulation configuration involving a mobile signal source in a second illustrative embodiment of the invention.

Referring now to FIG. 3, a communication system 300 is shown which includes a sound source 302 and three sensors 304-0, 304-1 and 304-2. It is assumed that the sensors 304 communicate with a processing device of the type shown in FIG. 1, although such a processing device is not explicitly shown in FIG. 3.

The communication system 300 is used as an exemplary simulation configuration to demonstrate the compression performance achievable in illustrative embodiments of the present invention. In this simulation configuration, the sensors 304 are placed along horizontal axis 305 and are separated from one another by a distance d. The sound source 302 is moving with speed v in a circle of radius r with the center of the circle on vertical axis 306 a distance c away from the horizontal axis. The middle sensor 304-0 is configured to take samples at the Nyquist rate, while the other two sensors 304-1 and 304-2 take compressive measurements in the manner described above. The signal source 302 is assumed to generate an acoustic signal given by $$s(t) = e^{-\frac{1}{2}\left(\frac{t}{\tau}\right)^2} \sin 2\pi f_0 t. \tag{17}$$

The following parameters are used in this simulation configuration $$d=1\text{ m}\quad c=7\text{ m}\quad r=5\text{ m}$$

$$v=0.47\text{ m/s}\quad f_0=16\text{ kHz}\quad \tau=10\text{ sec} \tag{18}$$

As noted above, the middle sensor 304-0 takes Nyquist samples of the arriving acoustic signal, at the sample rate of $f_s$=16 kHz, and the two side sensors 304-1 and 304-2 make compressive measurements of the arriving signals. The sampling matrix $\phi$ is formed from shifted m-sequences as described previously. Each measurement is a projection of N=4095 samples of $f_s$=16 kHz. In other words, the estimate of time delay is performed on blocks of N=4095 samples, which corresponds to a time duration of 0.256 seconds. For each block, M=40 measurements are used in the minimization process of Equation (14). For each set of measurements from sensors 304-1 and 304-2, the solution to the minimization problem in Equation (14) produces an estimate for the time difference of arrival between the side sensor and the middle sensor, $\Delta t^{(i)}$, by using Equation (11). The estimate is accurate up to the sample duration.

In this exemplary simulation configuration, an accurate localization result was achieved by using only M=40 measurements from each of the side sensors 304-1 and 304-2, as opposed to the Nyquist samples of N=4095. This represents a compression ratio of more than 100. In other words, each of the sensors 304-1 and 304-2 takes 40 measurements and transmits them to the processing center, instead of 4095 Nyquist samples. The compression ratio of more than 100 implies that the sensors are able to transmit the measurements much more reliably and power-efficiently. Also, the compression ratio is achieved with a very low complexity of projections, using the sampling matrix formed from shifted m-sequences.

The compressive sampling based approach in the illustrative embodiments provides an effective technique for localization of a sound source or other type of signal source in a sensor network. Compressive measurements can be used to reliably estimate the TDOA of acoustic signals at the sensors, without any assumption on the sparseness of the sound source. The simulation configuration described above demonstrates reliable detection and tracking of a sound source by using compressive measurements with a compression ratio of more than 100, as compared to conventional Nyquist sampling. The sensors making the compressive measurements can operate at substantially lower sampling and transmission rates, and can therefore be implemented at reduced cost and complexity, without reducing the accuracy of the localization result.

As indicated previously, embodiments of the present invention may be implemented at least in part in the form of one or more software programs that are stored in a memory or other computer-readable medium of a processing device. System components such as modules 112 and 114 may be implemented at least in part using software programs. Of course, numerous alternative arrangements of hardware, software or firmware in any combination may be utilized in implementing these and other system elements in accordance with the invention. For example, embodiments of the present invention may be implemented in one or more FPGAs, ASICs or other types of integrated circuit devices, in any combination. Such integrated circuit devices, as well as portions or combinations thereof, are examples of "circuitry" as the latter term is used herein.

It should again be emphasized that the embodiments described above are for purposes of illustration only, and should not be interpreted as limiting in any way. Other embodiments may use different types of signals, sensors, processing devices and localization techniques, depending on the needs of the particular signal source localization application. Alternative embodiments may therefore utilize the techniques described herein in a wide variety of other contexts in which it is desirable to implement efficient localization. Also, it should be noted that the particular assumptions made in the context of describing the illustrative embodiments should not be construed as requirements of the invention. The invention can be implemented in other embodiments in which these particular assumptions do not apply. These and numerous other alternative embodiments within the scope of the appended claims will be readily apparent to those skilled in the art.

What is claimed is:

1. A processing device comprising:

interface circuitry configured to receive compressive measurements of a signal from respective ones of a subset of a plurality of sensors and to receive a non-compressive measurement of the signal from at least a given one of the sensors not in the subset;

a delay determination module configured to process the compressive measurements in order to determine time delays between arrivals of the signal at different ones of the sensors; and a source localization module configured to determine a location of a source of the signal based on the time delays;

wherein the delay determination module is configured to determine respective time delays between arrivals of the signal at different ones of the sensors based at least in part on respective impulse response vectors, the respective impulse response vectors being sparse vectors characterizing impulse responses of respective channels between the signal source and respective ones of the sensors; and wherein the delay determination module is configured to compute respective ones of the impulse response vectors using the non-compressive measurement and a corresponding one of the compressive measurements.

2. The processing device of claim 1 wherein the signal comprises an acoustic signal.

3. The processing device of claim 1 wherein the non-compressive measurement comprises a relatively high sampling rate measurement and the compressive measurements comprise relatively low sampling rate measurements.

4. The processing device of claim 1 further comprising a processor coupled to a memory, wherein at least one of the delay determination module and the source localization module are implemented at least in part in the form of software stored in the memory and executed by the processor.

5. The processing device of claim 1 wherein the delay determination module is further configured to compute respective ones of the impulse response vectors utilizing sampling matrices corresponding to respective ones of the sensors in the subset, and wherein rows of a given one of the sampling matrices are formed using respective shifted maximum length sequences.

6. The processing device of claim 5 wherein entries of the given sampling matrix correspond to entries in respective ones of the shifted maximum length sequences.

7. The processing device of claim 1 wherein the delay determination module is configured to compute a given one of the impulse response vectors based at least in part on a minimization problem involving a sparsity basis formed using the non-compressive measurement, a compressive measurement from a given one of the sensors in the subset, and a sampling matrix corresponding to the given sensor.

8. A sensor comprising:

a signal detector;

a compressive sampling module for generating a compressive measurement from a detection output of the signal detector; and interface circuitry configured to transmit the compressive measurement to a processing device;

wherein the processing device utilizes the transmitted compressive measurement and a non-compressive measurement received from another sensor to compute an impulse response vector, the impulse response vector being a sparse vector characterizing an impulse response of a channel between a signal source and said sensor.

9. The sensor of claim 8 wherein said sensor is a given one of a plurality of sensors of a sensor network and wherein the given sensor operates at a lower sampling rate than said other sensor of the sensor network that does not generate a compressive measurement for transmission to the processing device.

10. The sensor of claim 8 wherein the compressive sampling module generates the compressive measurement as a product of a signal vector and a sampling matrix.

11. The sensor of claim 10 wherein the sampling matrix is formed using maximum length sequences.

12. The sensor of claim 10 wherein rows of the sampling matrix are formed using respective shifted maximum length sequences.

13. The sensor of claim 12 wherein entries of the sampling matrix correspond to entries in respective ones of the shifted maximum length sequences.

14. The sensor of claim 12 further comprising one or more linear feedback shift registers for computing the shifted maximum length sequences.

15. The sensor of claim 10 wherein entries of the sampling matrix are determined according to $$\phi_{ij}=1-2p_{(j+i)mod\ N}, i=1, \ldots, M, j=1, \ldots, N$$

where p denotes a binary maximum length sequence generated from a polynomial and the sampling matrix $\phi$ comprises an M×N matrix.

16. A method for performing localization of a signal source, comprising:

obtaining compressive measurements of a signal from respective ones of a subset of a plurality of sensors;

obtaining a non-compressive measurement of the signal from at least a given one of the sensors not in the subset;

processing the compressive measurements to determine time delays between arrivals of the signal at different ones of the sensors based at least in part on respective impulse response vectors, the respective impulse response vectors being sparse vectors characterizing impulse responses of respective channels between the signal source and respective ones of the sensors; and determining a location of the signal source based on differences between the time delays;

wherein respective ones of impulse response vectors aer computed using the non-compressive measurement and a corresponding one of the compressive measurements.

17. The method of claim 16 wherein the signal comprises an acoustic signal.

18. A non-transitory computer-readable storage medium having embodied therein executable program code that when executed by a processing device causes the processing device to perform the steps of the method of claim 16.

19. A system comprising:

a sensor network comprising a plurality of sensors; and a processing device configured to receive compressive measurements of a signal from respective ones of a subset of the sensors of the sensor network, to receive a non-compressive measurement of the signal from at least a given one of the sensors not in the subset, to process the compressive measurements in order to determine time delays between arrivals of the signal at different ones of the sensors, and to determine a location of a source of the signal based on the time delays;

wherein the processing device is configured to determine respective time delays between arrivals of the signal at different ones of the plurality of sensors based at least in part on respective impulse response vectors, the respective impulse response vectors being sparse vectors characterizing impulse responses of respective channels between the signal source and respective ones of the sensors; and wherein the processing device is configured compute respective ones of the impulse response vectors using the non-compressive measurement and a corresponding one of the compressive measurements.

20. The system of claim 19 wherein the sensors in the subset that generate the respective compressive measurements each operate at a lower sampling rate than that utilized by the given sensor that generates the non-compressive measurement.

* * * * *